US006145965A

United States Patent [19]

Inada et al.

[11] Patent Number: 6,145,965

[45] **Date of Patent: *Nov. 14, 2000**

[54] METHOD FOR MANUFACTURING AN INK JET HEAD, AND AN INK JET HEAD

[75] Inventors: Genji Inada; Norio Ohkuma, both of Yokohama, Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/665,499

[22] Filed: Jun. 18, 1996

[30] Foreign Application Priority Data

Jun. 20, 1995 [JP] Japan ..... 7-153270

[51] Int. Cl.[7] ..... B41J 2/015

[52] U.S. Cl. ..... 347/65; 347/20; 216/27

[58] Field of Search ..... 347/65, 63, 20; 29/890.1; 216/27

[56] References Cited

U.S. PATENT DOCUMENTS

| | | | |
|---|---|---|---|
| 4,723,129 | 2/1988 | Endo et al. | 347/56 |
| 5,017,947 | 5/1991 | Masuda | 347/65 |
| 5,331,344 | 7/1994 | Miyagawa et al. | 347/63 |
| 5,458,254 | 10/1995 | Miyagawa | 347/63 X |
| 5,478,606 | 12/1995 | Ohkuma et al. | 427/555 |
| 5,682,190 | 10/1997 | Hirosawa | 347/94 |
| 5,758,417 | 6/1998 | Kobayashi | 347/63 X |
| 5,777,649 | 7/1998 | Otsuka | 347/94 |

FOREIGN PATENT DOCUMENTS

| | | | |
|---|---|---|---|
| 0540047A2 | 5/1993 | European Pat. Off. | B41J 2/16 |
| 0573014A2 | 12/1993 | European Pat. Off. | B41J 2/16 |
| 0573023A1 | 12/1993 | European Pat. Off. | B41J 2/16 |

*Primary Examiner*—Richard Moses

*Attorney, Agent, or Firm*—Fitzpatrick, Cella, Harper & Scinto

[57] ABSTRACT

A method for manufacturing an ink jet head comprises a first step of arranging on a substrate a passage molding material to form ink paths conductively connected to discharge ports for discharging ink, a second step of arranging on the substrate an edge portion molding material in the vicinity of the passage molding material, a third step of arranging on the substrate a wall formation material to cover the passage molding material and the edge portion molding material, and a fourth step of forming the paths with the wall formation material by removing the passage molding material from the substrate. With this method, it is possible to manufacture an ink jet head having an ink chamber and nozzles, which are configured substantially the same as the molding members, without creating cracks and other defects that are liable to occur on the extruded corners of the passage molding material with respect to the substrate when the conventional technique is applied.

14 Claims, 12 Drawing Sheets

METHOD FOR MANUFACTURING AN INK JET HEAD, AND AN INK JET HEAD

BACKGROUND OF THE INVENTION

1. Field of the Invention

The present invention relates to a method for manufacturing an ink jet head, and an ink jet head manufactured by such method.

2. Related Background Art

An ink jet head is arranged to discharge ink from its nozzles as fine droplets for recording characters, images, and others. It has outstanding advantages as means for outputting images having high precision, as well as for printing at high speeds. Particularly, the method that uses pressure exerted by bubbles (air bubbles) created by electrothermal transducing elements (hereinafter referred to as heaters) or the like, that is, the so-called thermal ink jet recording method (disclosed in U.S. Pat. No. 4,723,129, is characterized in that such method enables an apparatus to be manufactured compactly, and that it makes it easier for the apparatus to record images in high density, among other advantages. FIG. 14 illustrates a thermal ink jet head described above as one example. FIG. 14 is a perspective view which shows the so-called side shooter type thermal ink jet head. FIG. 15 is a perspective view which shows the heater board that constitutes the head represented in FIG. 14.

The ink jet head shown in FIG. 14 is structured by bonding a nozzle plate member 102 having a plurality of orifices 101 arranged therein together with a substrate 103. On the substrate 103, an ink supply inlet 104 is opened as shown in FIG. 15. On the surface of the substrate 103, which is bonded to the nozzle plate member 102, a plurality of heaters 105 are arranged corresponding to the positions of the orifices 101.

Also, FIG. 16 is a cross-sectional view taken along line 16—16 in FIG. 14. As shown in FIG. 16, there are provided between the substrate 103, and the nozzle plate member 102, a liquid chamber 106 conductively arranged from the ink supply inlet 104 to the orifice 101 arranged above the heater 105, and a nozzle 107. Ink is supplied to the nozzle 107 from the ink supply inlet 104 through the liquid chamber 106. Then, ink is discharged from the orifice 101 by means of the pressure exerted by bubbles created on the heater 105.

The characteristic structure of the ink jet head described above is such that the space needed for the liquid chamber and the nozzle is formed by bonding the substrate 103 and the nozzle plate member 102 together.

This head can be structured by the steps of manufacture shown in FIGS. 17A to 17G. Hereunder, with reference thereto, the description will be made of a method for manufacturing an ink jet head described above.

A substrate 103 having the ink supply inlets 104 and heaters 105 provided in advance is prepared (see FIG. 17A). Then, a photoreactive positive type resist material 107, such as a dry-filmed ODUR (product name—manufactured by Tokyo Ohka Kabushiki Kaisha), is laminated thereon (see FIG. 17B). A molding member 109, which provides nozzles and a liquid chamber, is formed on the substrate 103 by means of photo-lithographic process (see FIG. 17C). The surface configuration of this molding member 109 is shown in FIG. 18. In FIG. 18, the portions designated by reference marks B and C are those where the nozzles and the liquid chamber are formed, respectively.

Then, by dissolving the following mixture into a solvent of xylene/cyclohexane=8/2 by 50 wt %, a resin material is obtained; this resin material is spin coated on the substrate 103 and the molding member 109 and hardened by use of light or heat, thus forming a nozzle plate member 102 (see FIG. 17D):

Nozzle plate material:

| | |
|---|---|
| Epicoat 1002 (product name - Yuka Shell Epoxy KK) | 100 parts |
| Epolite 3002 (product name - Kyouei Kabushiki Kaisha) | 20 parts |
| Irgacure 261 (product name - CIBA GEIGY) | 3 parts |

After this process, an oxygen-proof photohardening plasma material 110 is coated to form a thin film on the nozzle plate member 102, and then, removed sections 111 are formed by photolithographic process each in the shape of an orifice in a given position: here, the position facing each of the heaters (see FIG. 17E). Thus orifices 101 are formed on the nozzle plate member 102 by means of plasma irradiation (see FIG. 17F). The molding material 109 is dissolved and removed through the orifices and the ink supply inlets for the formation of the nozzles 107 and the liquid chamber 106 (see FIG. 17G).

The performance of ink discharge from the ink jet head produced by the method of manufacture described above depends greatly on the gap between the heater surface and the orifice formation surface. However, the structure being such that the nozzle plate member is formed by coating the resin material, it is easy to control the gap between the heater surface and the orifice formation surface. This gap exerts a serious influence on the ink discharge characteristics when heads are manufactured. The structure thus arranged also contributes to manufacturing them at lower costs. Further, it is possible to provide small droplets of less than 10 pl. Such small droplets are needed particularly for obtaining images having high precision. Moreover, since the orifices are formed by means of a photolithographic process, it is easy to position the heaters and orifices, among other features. A method for manufacturing a nozzle plate member by coating a resin material on a substrate having such a molding member on it is, hereinafter, referred to as a "resin plate injection molding method".

However, if a nozzle plate member as extremely thin as 100 $\mu$m or less should be formed by means of the manufacturing process shown in FIG. 3 in view of the fact that the narrower the gap between the heater surface and the orifice formation surface, the better the ink discharge characteristics, the coating condition of resin material on the nozzle plate member may sometimes become uneven in the vicinity of the corners of the extruded molding member on the substrate.

Now, with reference to FIG. 18 and FIG. 19, the description will be made of the problems to be encountered if such unevenness occurs. FIG. 19 is a cross-sectional view which shows the head portion when an extremely thin nozzle plate member is formed by means of the resin plate injection molding method.

In other words, a problem arises at a portion indicated by a reference mark E in FIG. 19, which corresponds to the portion D in FIG. 18. The thickness of the resin material coated on the substrate becomes locally thinner in the vicinity of the extruded corners of the molding member that produces the liquid chamber on the substrate. As a result, stress is concentrated on this thinner portion to create a crack 112 on the nozzle plate member. In a serious case, the liquid chamber is caused to sink in, resulting in an unfavorably reduced yield when ink jet heads are produced.

In order to avoid this drawback, it should be arranged to make the difference between the film thickness H of the nozzle and liquid chamber portion, and the film thickness h of the portions other than such portion as small as possible: preferably, the thicknesses H should be approximately equal to the thickness h, that is, the surface of the nozzle plate member should be made substantially flat. However, it is difficult to make any improvement in this respect just by devising some method for coating a resin material. Here, also, the process becomes complicated if coating should be repeated several times to obtain a flat surface, which inevitably brings about increased costs of ink jet head manufacture. Further, in order to improve the resin coating condition at the extruded corners of the molding member with respect to the substrate, it may be conceivable to coat the nozzle plate member in a sufficient thickness taking the thickness of such molding member into account. In this case, however, the resultant gap between the heater surface and the orifice formation surface becomes greater, thus making it difficult to design nozzles that can obtain specific discharge characteristics.

SUMMARY OF THE INVENTION

The present invention is designed in consideration of the problems encountered in the conventional technique described above. It is an object of the invention to provide a method for manufacturing an ink jet recording head, which is arranged to make it easier to prevent the thickness of a resin film from becoming thinner in the vicinity of the extruded corners of the molding member with respect to the substrate when the resin plate injection molding method is adopted for manufacturing ink jet heads.

In order to achieve the object described above, the present invention is designed with attention given to the phenomenon observed in the conventional method of manufacture that no cracking or the like occurs on the surface where nozzles are connected to the liquid chamber in a density more than a given value, that is, a portion indicated by a reference mark F in FIG. 19, for example, and that the nozzle plate member is formed substantially flat on the F portion when ink jet heads are manufactured accordingly.

In other words, therefore, a method for manufacturing an ink jet head in accordance with the present invention is structured such as to comprise a first step of arranging on a substrate a passage molding material to form ink paths conductively connected to discharge ports for discharging ink; a second step of arranging on the substrate an edge portion molding material in the vicinity of the passage molding material; a third step of arranging on the substrate a wall formation material to cover the passage molding material and the edge portion molding material; and a fourth step of forming the paths with the wall formation material by removing the passage molding material from the substrate.

In this respect, it may be possible to adopt a method characterized in that means is arranged for relaxing the inclination of the surface of the resin material in the vicinity of the edge portions of the molding member when the aforesaid resin material is superposed.

Or it may be possible to adopt a method characterized in that there is provided a peripheral member molding material configured to extrude from the liquid chamber molding material at least in a part other than the circumferential portion of the liquid chamber molding material where the nozzle member molding material is connected.

Or it may be possible to adopt a method characterized in that an isolated member is provided in a location having a given gap with or in contact with at least a part other than the circumferential portion of the liquid chamber molding material where the nozzle member molding material is connected.

Also, in either one of the methods of manufacture described above, the term "to superpose material" means a coating step in the method.

Further, in order to achieve the object of the present invention, an ink jet head manufactured by the method described above comprises a substrate having energy generating elements arranged thereon to generate energy to be utilized for discharging ink from the discharge ports, and a wall formation material connected to this board having recesses arranged to form the walls of the ink paths conductively connected with the discharge ports, wherein edge recesses different from the aforesaid recesses are further arranged for the wall formation material in the vicinity of the edge portions of the paths in the area for them to be connected with the aforesaid substrate.

In accordance with the present invention, a resin material is coated after having arranged on the substrate provided with pressure means on it a molding member comprising a liquid chamber molding material to form a common liquid chamber and a nozzle member molding material to form nozzles, and a peripheral member molding material configured to extrude from the side portion where the aforesaid nozzle member molding material is not connected with the circumference of the liquid chamber molding member. As a result, the film thickness of the resin material that covers the extruded corners of the molding member is not caused to become thinner with respect to the substrate. As a result, when the resin material is hardened and the molding member is removed, any portion whose thickness is locally thinned is not created on the nozzle plate member. Any cracking is not caused to occur on the nozzle plate member, either, thus improving the yield of ink jet heads when manufactured. Also, it may be possible to coat the resin material after an isolated member is arranged, instead of the aforesaid peripheral member molding material, in a position having a given gap with or in contact with the side portion where the nozzle member molding material is arranged on the circumference of the liquid chamber molding material. In this case, too, the same effect is obtainable as in the arrangement described above.

Other objectives and advantages besides those discussed above will be apparent to those skilled in the art from the description of a preferred embodiment of the invention which follows. In the description, reference is made to the accompanying drawings, which form a part hereof, and which illustrate an example of the invention. Such example, however, is not exhaustive of the various embodiments of the invention, and therefore reference is made to the claims which follow the description for determining the scope of the invention.

DETAILED DESCRIPTION OF THE PREFERRED EMBODIMENTS

Hereinafter, with reference to the accompanying drawings, the description will be made of the embodiments in accordance with the present invention.

(First Embodiment)

Figure 1:
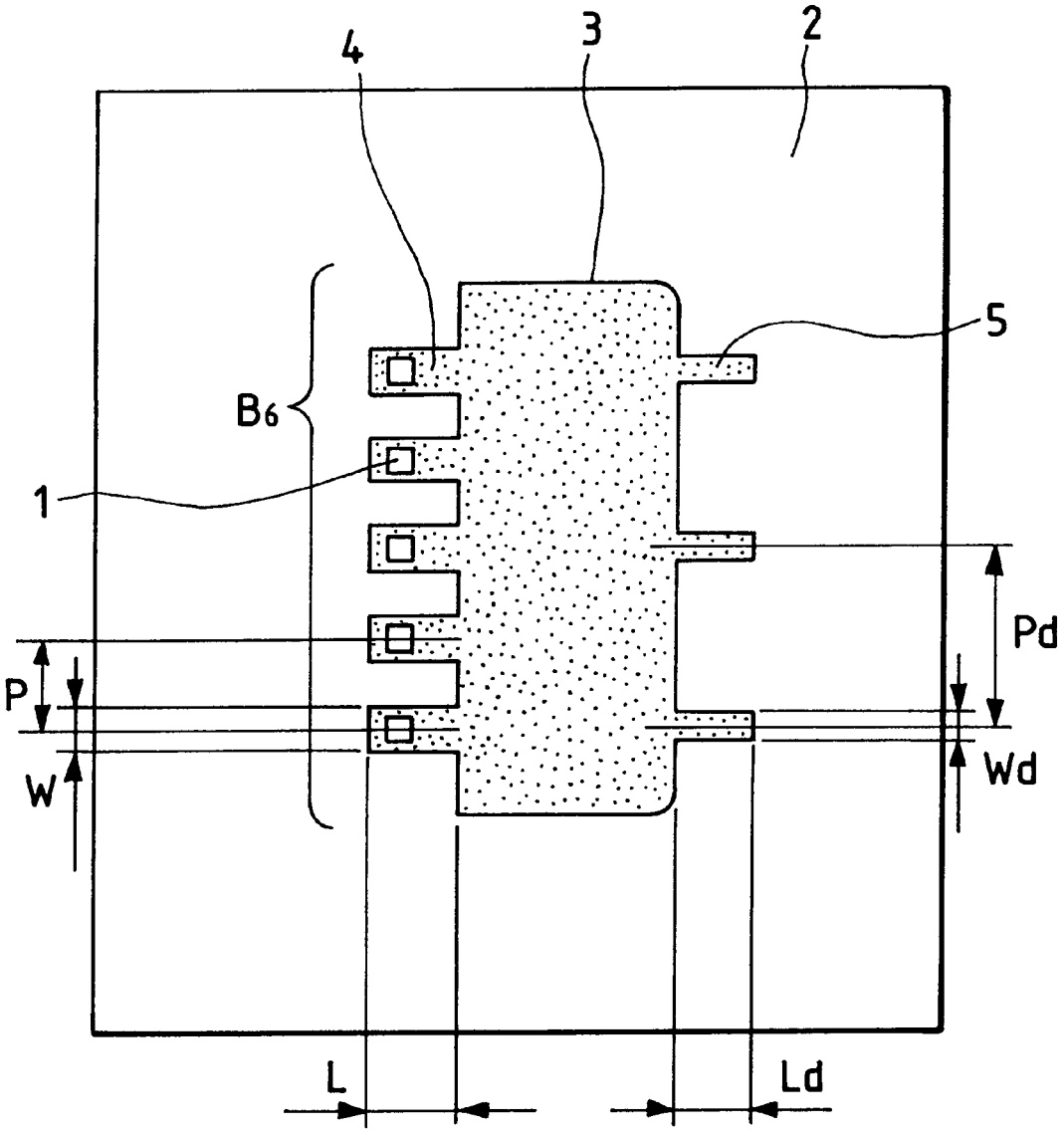
FIG. 1 is a plan view showing the configuration of the molding member which is characteristic of the method for manufacturing an ink jet head in accordance with a first embodiment of the present invention.

FIG. 1 is a plan view showing the configuration of a molding member which is characteristic of the method for manufacturing an ink jet head in accordance with a first embodiment of the present invention.

The present embodiment is such that when the nozzles and liquid chamber are formed for an ink jet head by means of the aforesaid resin plate injection molding method, a plurality of extrusions, which are analogous to the nozzles, are arranged on the circumference of the molding member at given intervals on the substrate.

In other words, as shown in FIG. 1, a dry-filmed photoreactive positive type resist material, such as ODUR (product name—manufactured by Tokyo Ohka Kabushiki Kaisha), is laminated on a substrate 2 having the ink supply inlet (not shown) and heaters 1 prepared in advance as in the conventional technique. Then, by means of a photolithographic process, a molding member is formed on the substrate 2. This molding member comprises nozzle member molding material 4 to cover each of the heaters 1 on the substrate 2 in order to form nozzles in the portion at $B_6$ in FIG. 1; a liquid chamber molding material 3 connected with the end of each nozzle member molding material 4 to form a liquid chamber; and peripheral formation members 5 each extruded from the circumference of the liquid chamber molding material in the portion other than those where each one end of the nozzle member molding material 4 is connected. Thereafter, the processing steps are the same as those shown in FIGS. 17D to 17G. Therefore, the description thereof will be omitted.

Figure 19:
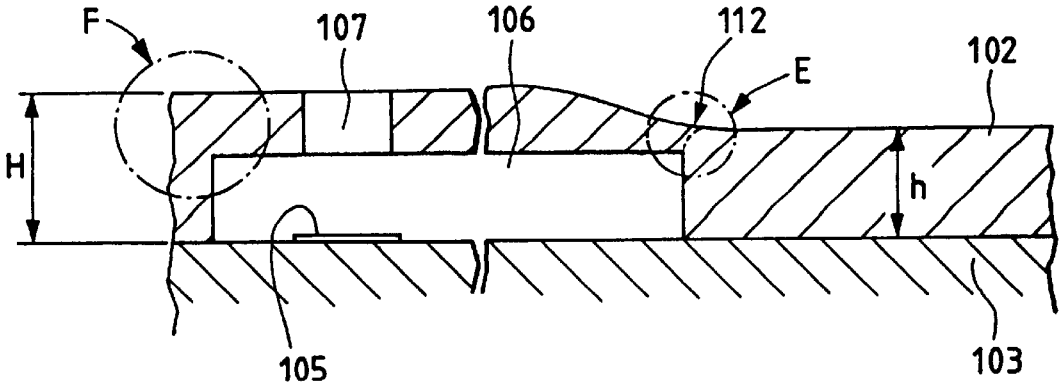
FIG. 19 PRIOR ART
FIG. 19 is a partially cross-sectional view of a head when an extremely thin nozzle plate member is formed therefor by means of the resin plate injection molding method.

In accordance with the present embodiment, the distance equivalent to the thickness of the nozzle plate member H shown in FIG. 19, is defined as 0.025 (mm); the thickness t of the molding member=0.015 (mm); the distance L from the connecting portion of the nozzle and the liquid chamber is equal to 0.12 (mm); the nozzle pitch=0.0635 (mm); and the nozzle width=0.045 (mm). Also, one peripheral member molding material 611 is arranged by a distance Ld from its connecting portion with the liquid chamber to the leading end of the member, which is 0.1 (mm) and the width Wd of 0.03 (mm) at an interval of pitch Pd of 0.127 (mm).

Now, an ink jet head is manufactured by means of the resin plate injection molding method using the molding member configured as shown in FIG. 1, with the result that the liquid chamber and nozzles are obtained in the configuration, which is substantially the same as the molding member shown in FIG. 1. Also, for the ink jet head of the present embodiment, its nozzle plate member corresponding to the E portion in FIG. 19, for example, is not made locally thinner in the vicinity of the extruded corners of the molding member with respect to the substrate. Therefore, it is also possible to eliminate most of the defects, such as cracking. In this respect, as a comparative sample, the conventional ink jet head is produced in the same conditions as described above, but without using the peripheral member molding material 5. The result is that cracking is caused on the nozzle plate member when an ultrasonic cleaning is executed in the dissolution step of the molding member.

As described above, in accordance with the present embodiment, each peripheral member molding material 5 is arranged to protrude at given intervals from the circumference of the liquid formation member 3 in the portion other than those where this member is connected with the nozzle member molding material 4. In this way, it is possible to solve the problem, such as the creation of cracks and others, conventionally encountered in the manufacture of ink jet heads by means of the resin plate injection molding method.

In accordance with the embodiment described above, the peripheral member molding material 5 is in the extruded form, which is analogous to the nozzle member molding material, but if, for example, the thickness t of the molding member is 0.05 (mm) or less, and the thickness of the nozzle plate member is 0.2×t to 2.0×t on the circumference of the orifice, it should be arranged to obtain a peripheral member molding material by means of a patterning process with a resist material applied to the molding member so that the peripheral member is formed in a configuration such as having a distance Ld from the connecting portion of the liquid chamber to the leading end, which is 0.01 (mm) or more, the ratio between the width Wd and the thickness t being 4.0 or less, and the ratio between the width Wd and the arrangement interval of each of the peripheral member molding material being approximately 0.01 to 0.95.

Figure 2A:
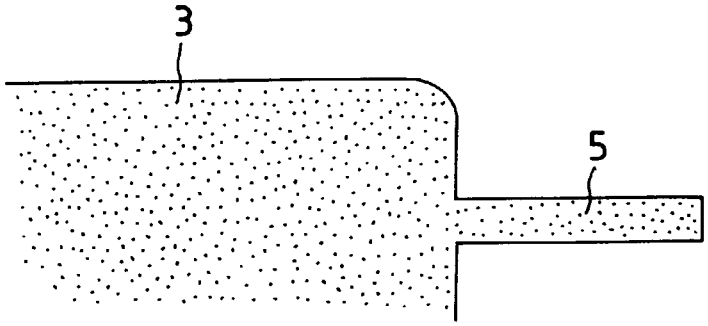
FIGS. 2A to 2C are views which illustrate the configuration of the liquid chamber obtainable by means of the method of manufacture in accordance with the first embodiment of the present invention.
Figure 2B:
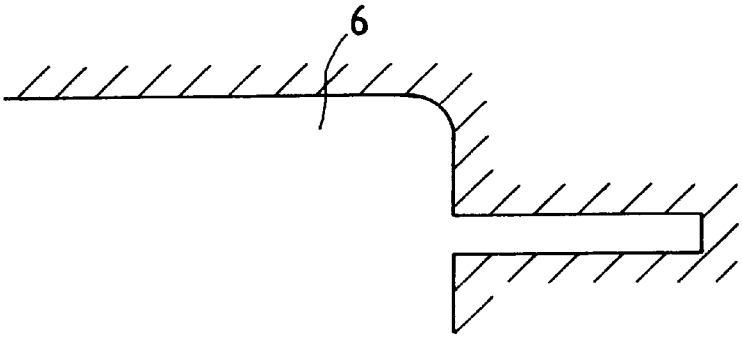
Figure 2C:
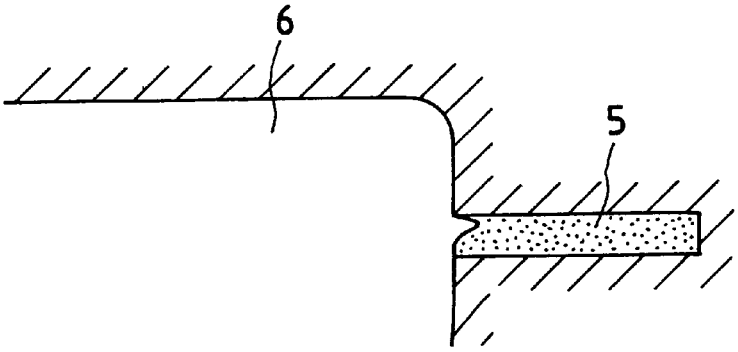

FIGS. 2A to 2C are views illustrating the configuration of a liquid chamber obtained by the method of manufacture in accordance with the first embodiment of the present invention.

As shown in FIG. 2A, when the molding member having the peripheral member molding material 5 is used in the configuration described above, it is possible to obtain a liquid chamber as shown in FIG. 2B after the completion of the processing if such processing is desirably carried out. In some cases, however, the molding member residing in the leading end portion of the peripheral member molding material is not removed completely when the molding member is dissolved and removed. As a result, the circumference of the liquid chamber 6 is not in the extruded shape as shown in FIG. 2C. Nevertheless, this situation may be considered as one of the execution modes of the present invention. In this case, it is conceivable that the molding material can be easily removed by providing an aperture for the nozzle plate member immediately above the peripheral member molding material 5. Here, the aperture should be conductively connected with the peripheral member molding material 5.

Also, in accordance with the present embodiment, the peripheral member molding material is arranged only in one location shown in FIG. 1. The present invention is not necessarily limited to this arrangement, but it may be possible to arrange this material on a part of the location where no particular drawback takes place when this material becomes a part of an ink jet head or on the entire part thereof on the circumference of the liquid chamber molding material other than the locations where such material is connected with the nozzle member molding material.

Moreover, there is no need for each peripheral member molding material to be arranged at equal intervals if only the material is provided within a range that can demonstrate a specific effect.

(Second Embodiment)

Figure 3:
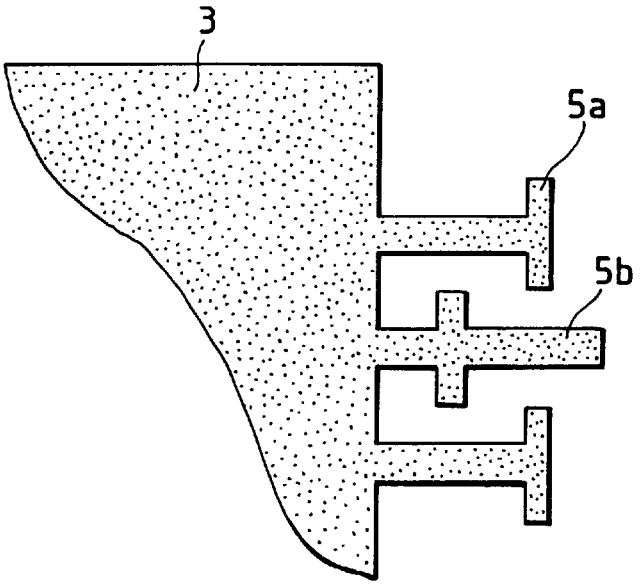
FIG. 3 is a plan view partially showing the circumferential configuration of a molding member which is characteristic of the method for manufacturing an ink jet head in accordance with a second embodiment of the present invention.

FIG. 3 is a plan view partly showing the circumferential configuration of a molding member, which represents the characteristic part of the method for manufacturing an ink jet head in accordance with a second embodiment of the present invention.

The molding member used for the present embodiment is configured with plural kinds of peripheral member molding materials 5*a,* 5*b,* and the like, which are connected with one and the same liquid chamber molding material 3 as shown in FIG. 3. With a molding configuration such as this, it is possible to obtain the same effect as the first embodiment.

(Third Embodiment)

Figure 4:
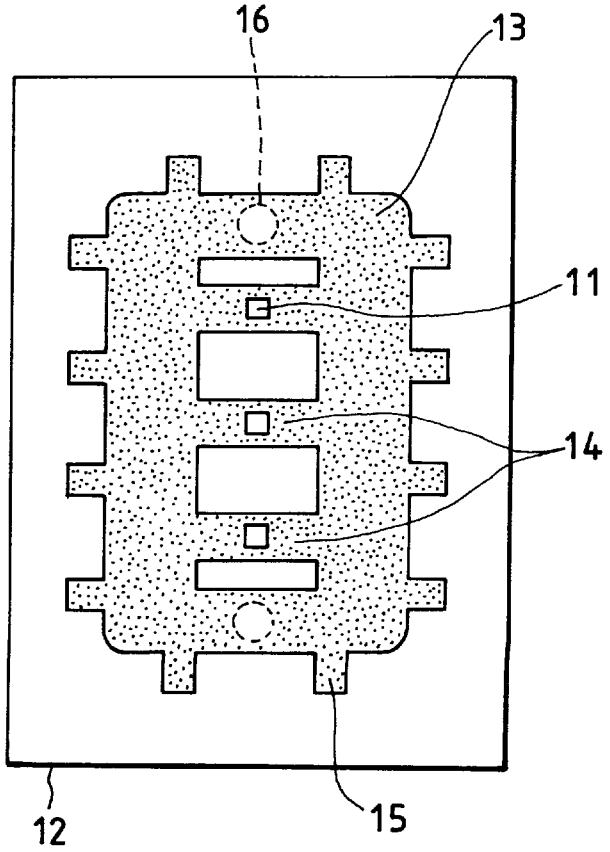
FIG. 4 is a plan view showing the configuration of a molding member which is characteristic of the method for manufacturing an ink jet head in accordance with a third embodiment of the present invention.

FIG. 4 is a plan view showing the configuration of a molding member, which is characteristic of the method for manufacturing an ink jet head in accordance with a third embodiment of the present invention.

The present embodiment is an example in which the method of manufacture of the present invention is adopted when an ink jet head is manufactured with the formation of nozzles by arranging in the liquid chamber the nozzle separation wall members isolated from the circumference of the liquid chamber.

In other words, as shown in FIG. 4, a dry-filmed photoreactive positive type resist material, such as ODUR (product name—manufactured by Tokyo Ohka Kabushiki Kaisha), is laminated on the substrate 12 on which heaters 11 and ink supply inlets 16 are provided in advance as in the conventional technique. Then, by means of a photolithographic process, a molding member is formed on the substrate 12, which comprises a nozzle member molding material 14 to cover each of the heaters 11 on the substrate 12 in order to form nozzles; a liquid chamber molding material 13 connected with both ends of each of the nozzle member molding materials 14 in order to form the liquid chamber of an ink jet head where the nozzle separation wall members are arranged in isolation from the circumference of the liquid chamber; and peripheral member molding materials 15 each extruded from the circumference of the liquid chamber molding material 13 at specific intervals. Thereafter, the processing steps are the same as those represented in FIGS. 17D to 17G. The description thereof will be omitted.

With the substrate having the molding member thereon, which is obtainable as described above, the nozzle plate member is not made thinner in the vicinity of the extruded corners of the molding member as in the first embodiment. Therefore, it is possible to eliminate most of the defects, such as cracking.

(Fourth Embodiment)

Figure 5:
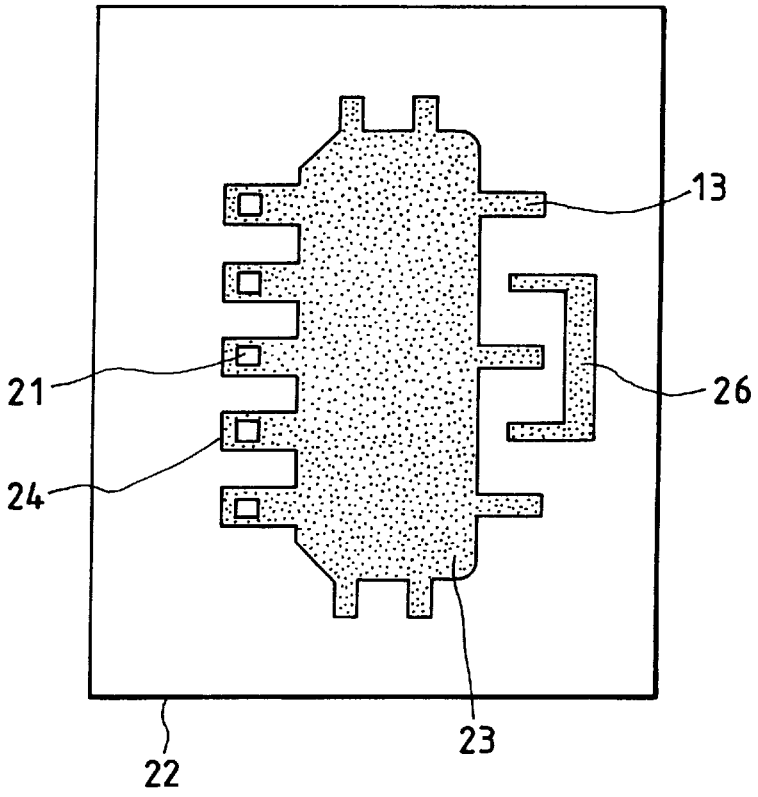
FIG. 5 is a plan view showing the configuration of a molding member which is characteristic of the method for manufacturing an ink jet head in accordance with a fourth embodiment of the present invention.

FIG. 5 is a plan view showing the configuration of a molding member, which is characteristic of the method for manufacturing an ink jet head in accordance with a fifth embodiment of the present invention.

In other words, as shown in FIG. 5, the molding member used for the present embodiment comprises a nozzle member molding material 24 to cover each of the heaters 21 on the substrate 22 in order to form nozzles; a liquid chamber molding material 23 to form a liquid chamber; peripheral member molding materials 25 each extruded from the circumference of the liquid chamber molding material 23 at specific intervals in a portion other than those where one end of each of the nozzle member molding materials 24 is connected therewith; a molding material pattern 26 arranged on the substrate 22 in a portion away by a given distance from the peripheral member molding material 25 of the liquid chamber molding material 23.

In accordance with the present embodiment, it is possible to eliminate cracking and other defects as in the first embodiment.

Now, hereunder, several methods of manufacture will be described, which are arranged as the present embodiment to be able to prevent the nozzle member from becoming thinner in the vicinity of the extruded corners of the molding member with respect to the substrate by providing a molding material pattern (hereinafter referred to as an isolated member) for the substrate in a portion away by a given distance from the circumference of the molding member.

(Fifth Embodiment)

FIGS. 6A to 6F are views illustrating each of the processing steps of the method for manufacturing an ink jet head in accordance with a fifth embodiment of the present invention.

In accordance with the present embodiment, when the liquid chamber is formed for an ink jet head by means of the resin plate injection molding method shown in FIGS. 17A to 17G, an isolated member is provided by use of a resin material applied to forming the nozzle plate member in a position away by a given distance from the nozzle member molding material or liquid chamber molding material.

Figure 6A:
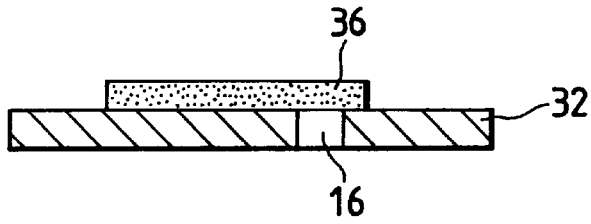
FIGS. 6A to 6F are views which illustrate the steps in a method for manufacturing an ink jet head in accordance with a fifth embodiment of the present invention.

In other words, a photoreactive positive type resist material is laminated on the substrate 32 on which the heaters and ink supply inlets are formed in advance, and by means of a photolithographic process, the molding member 36 is formed for the provision of nozzles and a liquid chamber (see FIG. 6A).

Figure 6B:
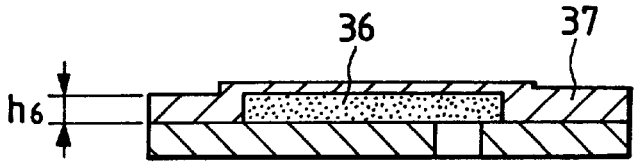
Figure 6C:
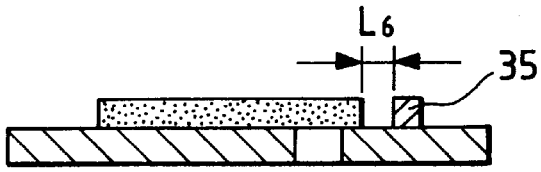

Further, on the substrate 32 and the molding member 36, a first coating of a resin material 37 is conducted for the formation of the nozzle plate member (see FIG. 6B). Here, it is desirable to make the thickness $h_6$ of the resin material 37 obtained by the first coating on the substrate substantially the same as that of the molding member 36. The resin material 37 can be selectively hardened by means of light. For the present embodiment, an isolated member 35 is formed by means of resin patterning in a location apart from the side face of the molding member 36 by a given distance $L_6$ (see FIG. 6C).

Figure 7:
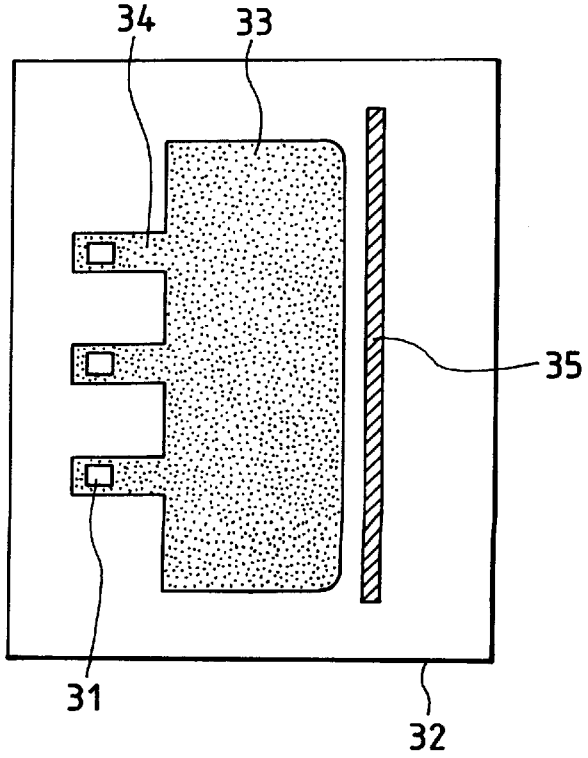
FIG. 7 is a plan view showing the state of arrangement with respect to the molding member that becomes nozzle and liquid chamber, and an isolated member.

Here, FIG. 7 is a plan view which shows the arrangement of the molding member becoming the nozzles and the liquid chamber, as well as the isolated member. As shown in FIG. 7, a molding member is structured with a nozzle member molding material 34 that covers each of the heaters 31 on the substrate 32 for the formation of nozzles, and a liquid chamber molding material 33 to form the liquid chamber, and also, a straight lined isolated member 35 is arranged in a position apart by a given distance from one side face of the liquid chamber molding material 33, this side being opposite to the portion where the nozzle member molding material is connected therewith.

Then, on the substrate 32, the molding member, and the isolated member 35, a second coating is conducted by use of a photo- or thermo-hardening resin material, which is the same as the material of the isolated member 35. This resin material is hardened by means of light or heat on the entire surface of the substrate, thus forming the nozzle plate member 38 (see FIG. 6D).

Figure 6D:
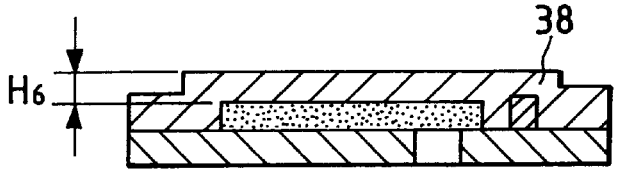
Figure 6E:
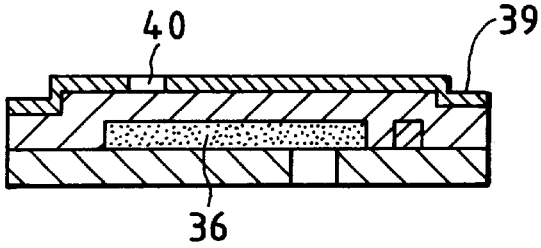
Figure 6F:
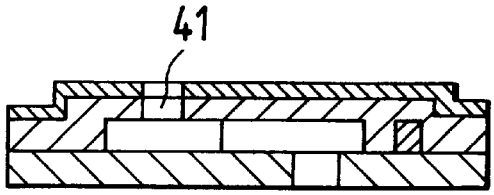
Figure 8A:
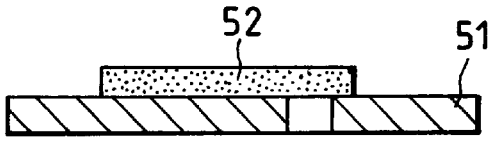
FIGS. 8A to 8F are views illustrating the steps in a method for manufacturing an ink jet head in accordance with a sixth embodiment of the present invention.
Figure 8B:
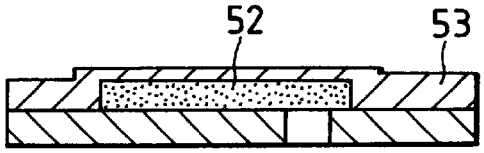
Figure 8C:
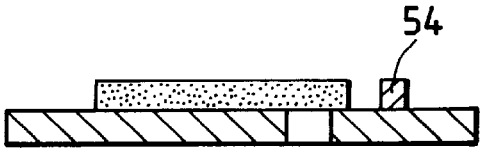
Figure 8D:
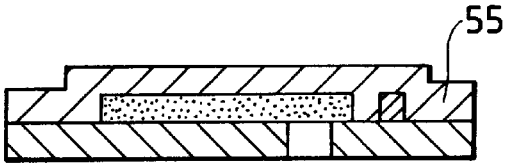
Figure 8E:
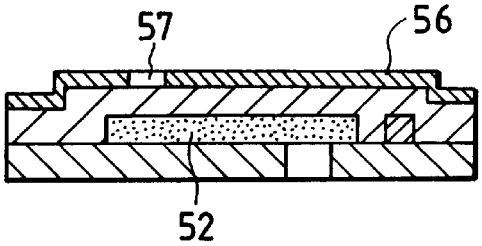
Figure 8F:
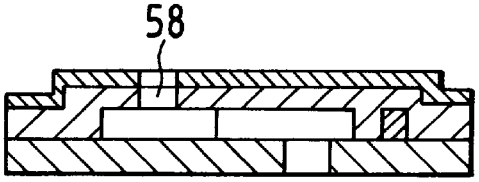

Thereafter, a photohardening type oxygen proof plasma material 39 is coated to make a thin film on the nozzle plate member 38, and by means of a photolithographic process, removed sections 40 are formed in specific positions: here, the positions are such as to face each of the heaters (see FIG. 6E). Then, by means of the plasma irradiation, orifices 41 are formed on the nozzle plate member 38. The molding member 36 is dissolved and removed to form the nozzles and the liquid chamber (see FIG. 6F).

In this respect, the distance $L_6$ between the one side face of the molding member 36 and the isolated member 35 shown in FIG. 6E can be appropriately selected depending on the film thickness $H_6$ of the nozzle plate member 38 on the molding member 36 so as to arrange the surface of the nozzle plate member 38 to be substantially horizontal with respect to the substrate 601. Here in accordance with the present embodiment, given $H_6 \leqq 0.1$ (mm), for example, such distance is approximately $L_6 < 20 \times H_6$.

In accordance with the present embodiment, the isolated member 35 acts like a bank so as to prevent the resin material, which becomes the nozzle plate member, from flowing out on the circumference of the molding member 36. Therefore, the thickness of the resin material is not made locally thinner in the vicinity of the extruded corners of the molding member with respect to the substrate. In this way, it is possible to prevent the occurrence of the cracking and other defects.

Also, since the isolated member 35 and the nozzle plate member 38 are formed by one and the same material, the close adhesiveness of these members is excellent, and also, this arrangement makes it easier to carry out process controls at the time of manufacture.

(Sixth Embodiment)

FIGS. 8A to 8F are views illustrating each of the processing steps of the method for manufacturing an ink jet head in accordance with a sixth embodiment of the present invention.

As shown in FIGS. 8A to 8F, the present embodiment is a method of manufacture in which an isolated member 54 is arranged apart by a given distance from one side face of a molding member 52 as in the fifth embodiment (see FIG. 7). However, this isolated member 54 is formed by a material 55 different from the resist material of the molding member 52 and the material of the nozzle plate member 55. This is the only difference between the methods of the fifth embodiment and present one.

As the material 53 of the isolated member 54, it is conceivable to use the photoreactive negative type resist, ORDYL SY300 (product name—manufactured by Tokyo Ohka Kabushiki Kaisha).

If the molding member 52 is formed by a positive type resist, it is preferable to shield the molding member 52 in order to avoid any photoreaction of the molding member 52 when the isolated member 54 is being patterned.

Also, for the material of the molding member 52 to be used for the present embodiment, it is necessary to select one which is not dissolved by use of the development agent applied to the material 53 when the material 53 is being patterned.

Further, in accordance with the present embodiment, the isolated member 54 remains in the nozzle plate member 55 after the formation of the nozzle plate member 55 is completed. Therefore, it is desirable to select a material for the isolated member, the chemical and mechanical properties of which are close to those of the material used for the nozzle plate member.

(Seventh Embodiment)

FIGS. 9A to 9E are views illustrating each of the processing steps of the method for manufacturing an ink jet head in accordance with a ninth embodiment of the present invention.

As shown in FIGS. 9A to 9E, the present embodiment is also the method of manufacture in which an isolated member 64 is arranged apart by a given distance from one side face of a molding member 64 as in the fifth embodiment and sixth embodiment (see FIG. 7). However, what differs from the fifth and sixth embodiments is that the isolated member 63 is formed by the same resist material as that of the molding member 63.

Figure 9A:
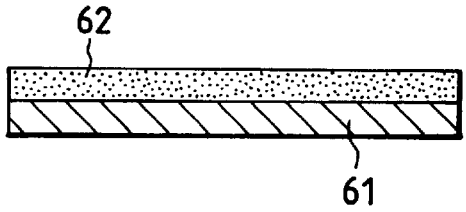
FIGS. 9A to 9E are views illustrating the steps in a method for manufacturing an ink jet head in accordance with a seventh embodiment of the present invention.
Figure 9B:
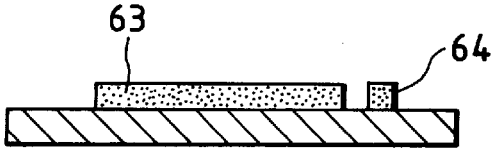

In other words, the resist material 62 is laminated on the substrate 61 on which heaters and ink supply inlets (not shown) are arranged in advance (see FIG. 9A). Then, by means of a photolithographic process, there are formed the molding member 63 to produce nozzles and a liquid chamber, and the isolated member 64 arranged apart from the molding member 63 by a given distance (see FIG. 9B).

Figure 9C:
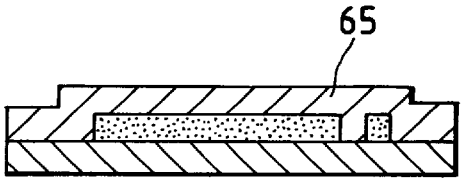

Subsequently, a photosetting or thermosetting resin is coated on the substrate 61, the molding member 63 and the isolated member 64 to form a nozzle plate member 65 (see FIG. 9C).

Figure 9D:
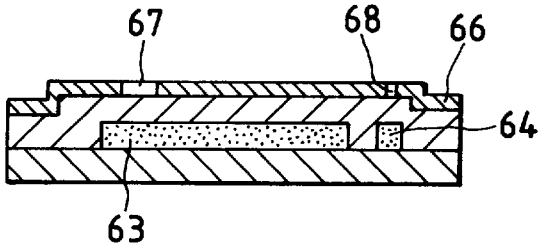
Figure 9E:
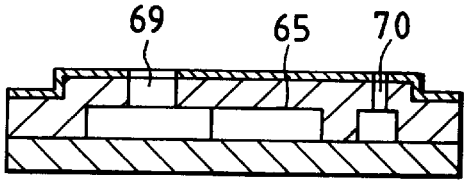

Thereafter, a photohardening type oxygen proof plasma material 66 is coated to make a thin film on the nozzle plate member 102, and then, by means of photolithographic process, removal sections 67 are formed in specific positions in the shape of the orifice: here, the positions are arranged to face the respective heaters (see FIG. 9D). By the irradiation of plasma, orifices are formed on the nozzle plate member 65. The molding member 63 is dissolved and removed, thus forming the nozzles and liquid chamber (see FIG. 9E).

However, if a material that may generate gas by reaction caused by means of light or the like, such as ODUR (product name—manufactured by Tokyo Ohka Kabushiki Kaisha), is used as a resist material 62 for the method of manufacture described above, it is also conceivable to arrange a removal section 67 on the oxygen proof plasma material 66 formed on the nozzle plate member 65, at the same time, forming a removal section 68 for the formation of a hole to remove the gas to be generated when the isolated member 64 is hardened by means of reaction (see FIG. 9D). After that, by the plasma irradiation, a degasification hole 70 is formed on the nozzle plate member 65 through the removal section 68 (see FIG. 9E).

In this respect, the processing step for the provision of the degasification hole 70 may be applicable to the fourth embodiment shown in FIG. 5 or the sixth embodiment shown in FIGS. 8A to 8F.

(Seventh Embodiment)

Figure 10:
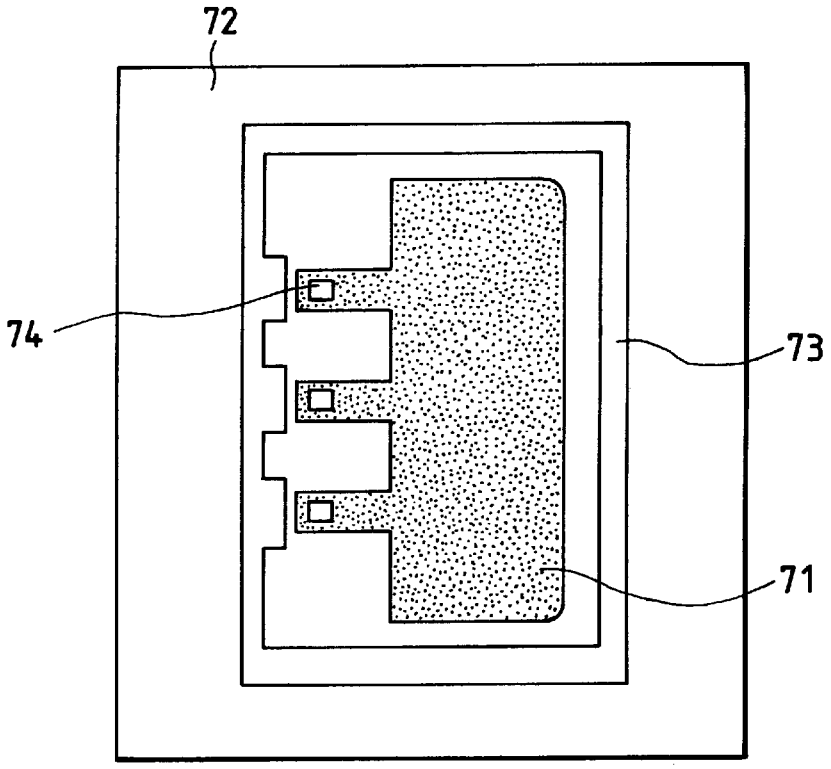
FIG. 10 is a plan view which shows another example of the isolated member.
Figure 11:
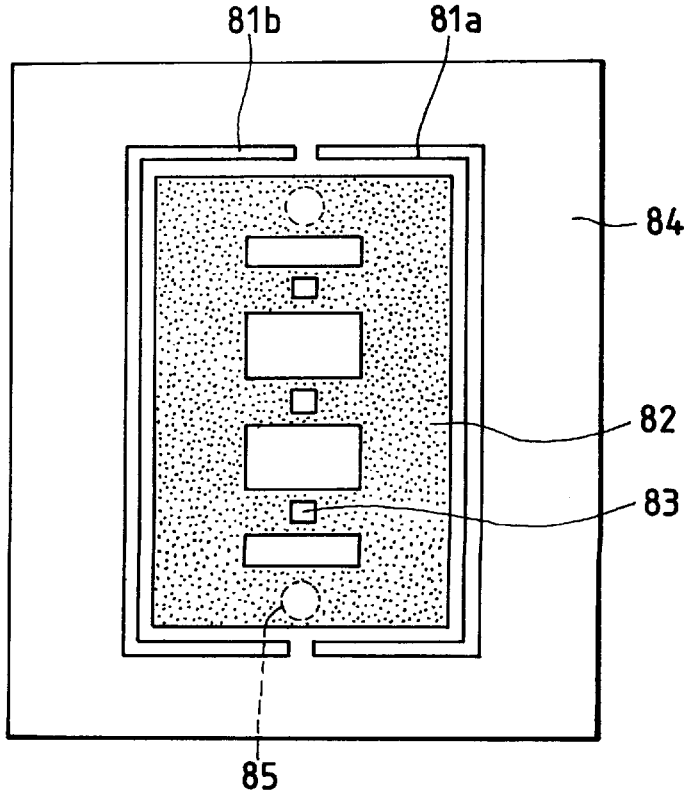
FIG. 11 is a plan view which shows still another example of the isolated member.

The configuration of the isolated member used for the fifth and sixth embodiments is not necessarily limited to the one shown in FIG. 7, but conceivably, the configurations shown in FIG. 10 and FIG. 11 are adoptable.

FIG. 10 and FIG. 11 are plan views showing other examples of the configuration of the isolated member, respectively.

In other words, the isolated member 73 shown in FIG. 10 is formed on the substrate 72 to surround the molding member 71 entirely apart from it by a given distance. Here, the molding member comprises the nozzle member molding material to cover each of the heaters 74 on the substrate 72 for the formation of nozzles, and the liquid chamber molding material connected to the one end of each nozzle member molding material.

Also, the isolated members 81*a* and 81*b* shown in FIG. 11 are formed on the substrate 84 separately to surround the molding member 82 entirely apart from them by a given distance. The molding member comprises the nozzle member molding material to cover each of the heaters 83 on the substrate 84 for the formation of nozzles, and the liquid chamber molding material connected to both ends of each nozzle member molding material for the formation of the liquid chamber for an ink jet head to be arranged in the liquid chamber by arranging the nozzle separation wall members to be isolated from the circumference of the liquid chamber.

In accordance with the method that uses the isolated member structured in either way as described above, it is possible to prevent the occurrence of cracking and other defects, because the thickness of the resin material is not made thinner in the vicinity of the extruded corners of the molding member with respect to the substrate as in the first to sixth embodiments.

In this respect, the present invention is not necessarily limited to the molding configurations shown in FIG. 7, FIG. 10, and FIG. 11, and there is no need for the surface of the nozzle plate member to be flat between the molding member and the isolated member with respect to the surface of the substrate if only the molding configuration is such that the thickness of the nozzle plate member is not made to cause cracking or other defects on the extruded corners of the molding member with respect to the substrate after the head is manufactured.

(Eighth Embodiment)

Further, there is no need for each of the isolated members of the fifth to seventh embodiments to be a member separated from the nozzle member and liquid chamber molding materials.

Figure 12:
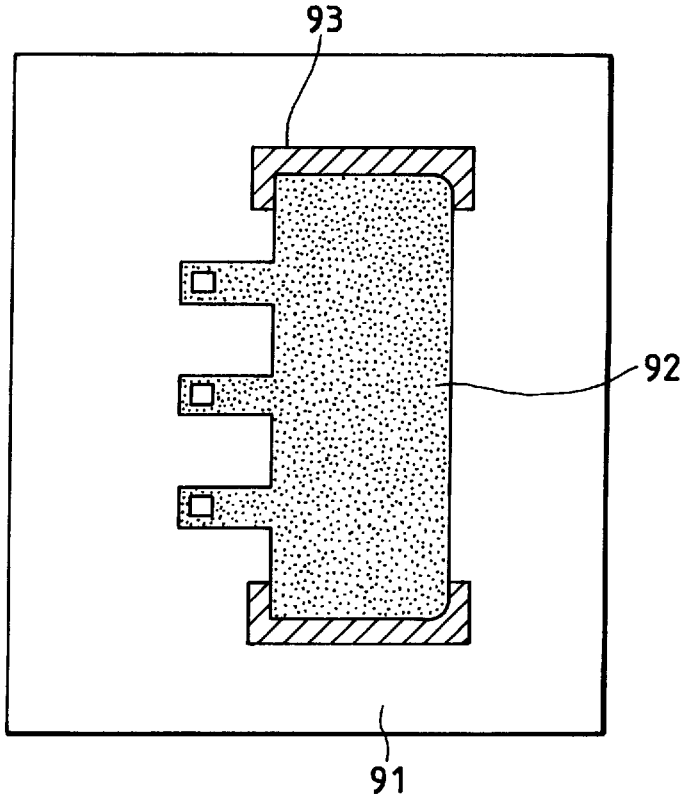
FIG. 12 is a plan view showing the configuration of a molding member which is characteristic of the method for manufacturing an ink jet head in accordance with an eighth embodiment of the present invention.

FIG. 12 is a plan view showing the configuration of a molding member which is characteristic of the method for manufacturing an ink jet head in accordance with an eighth embodiment of the present invention.

In accordance with the present embodiment, a molding member 93 is arranged to be in contact with a liquid chamber molding material of a molding member 92 formed on the substrate 91 as shown in FIG. 12, and then, a nozzle plate member molding material is coated on the substrate 91. Conceivably, after the material of the molding member 93 is hardened by means of light or heat, it may be kept remaining as a part of the walls of the liquid chamber for an ink jet head without dissolving such material for removal together with the molding member 92.

Also, in accordance with the fifth embodiment to the seventh embodiment described above, it may be possible to arrange an isolated member locally only on the location where the crack and other defects are liable to occur. Further, it may be possible to arrange isolated members in several kinds of configurations with a gap or in contact with the circumference of one and the same liquid chamber molding material.

(Ninth Embodiment)

Figure 13A:
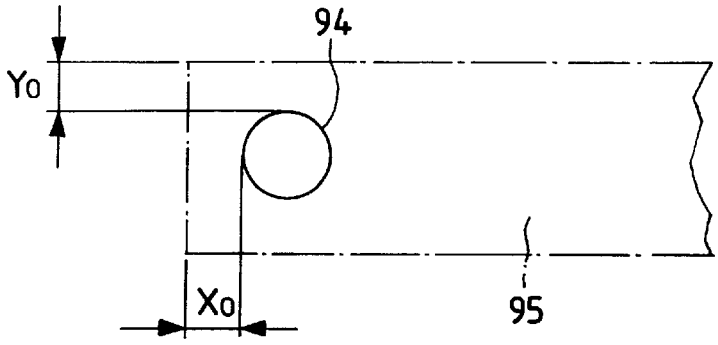
FIGS. 13A and 13B are views illustrating the positional relationship of protection of the nozzle and orifice to the substrate, the nozzle and orifice being structured by the nozzle walls which essentially surround the circumference of the heater in the three directions.
Figure 13B:
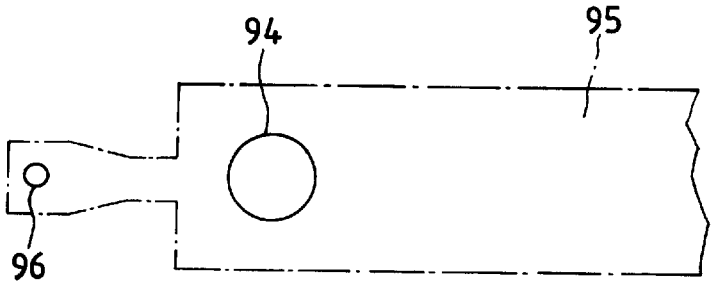

In addition, it is preferable to adopt modes shown in FIGS. 13A and 13B if a nozzle configuration is formed by means of the resin plate injection molding method so that the configuration of the nozzle walls, which is projected to the substrate, may essentially surround the heater circumference in the three directions when the nozzle configuration of an ink jet head is eliminated from the molding configuration such as shown in FIG. 4 and FIG. 11.

FIGS. 13A and 13B are views which illustrate the positional relationship of projection of the nozzle and orifice to the substrate, which are structured by nozzle walls that essentially surround the heater circumference in three directions.

The case of a nozzle 95 configured as shown in FIG. 13A, it is preferable to set the gaps $X_0$ and $Y_0$ between the orifice 94 and the nozzle wall at $0.05 \times H_6$ or more including the alignment tolerance of both of them, provided that the film thickness $H_6$ of the nozzle plate member on the molding member is <0.1 (mm) (see FIG. 6D). More preferably, it should be set at $0.1 \times H_6$ or more.

Also, conceivably, in order to improve the dissolution and removal of the molding member in each of the nozzles, a small hole 96, which is not used for discharging droplets, may be arranged through the surface of the nozzle plate to the nozzle 95 in the vicinity of the leading end of the nozzle 95 as shown in FIG. 13B.

The present invention is not necessarily limited to the molding member and nozzle plate member molding material, which are specifically referred to in the embodiments as described above. Also, the present invention is not necessarily limited to a method for manufacturing an ink jet head of a specific configuration where such method of manufacture uses the resin plate injection method in accordance with the thought of the present invention. Also, if the nozzle plate member is not made thinner locally so that it can maintain its strength to the extent that no defects are caused by the application of the method of the present invention, the flatness of the nozzle plate member is not necessarily regarded as a prerequisite factor.

In this respect, if a molding member is formed by photosensitive resin, there may be some cases where the projected configuration to the substrate creates a wavy pattern on the surface on the resist side after the completion of patterning, depending on the luminous energy at exposure and the focusing conditions of the exposed pattern. If such case should ensue, a formation of this kind is not necessarily included in the method of the present invention, because the irregularities in such size, which may be formed naturally on the surface on the resist side depending on the exposure conditions, are usually beyond the controlled prevention of the molding member from becoming thinner at the extruded corners thereof when a nozzle plate member molding material is coated on it.

The present invention being structured as described above, it can demonstrate effects given below.

A molding member comprises a liquid chamber molding material to form a common liquid chamber; a nozzle member molding material to form nozzles; and a peripheral member molding material configured to be in extrusions from the side portion of the nozzle member molding material where the nozzle member molding material on the circumference of the liquid chamber molding material is not connected with the molding member. After this molding member is arranged on a substrate having pressure generating means on it, a resin material is coated to make it possible to hold flatness without causing the film thickness of the resin material coated in the vicinity of the extruded corners of the molding member with respect to the substrate. As a result, no cracking takes place on the nozzle plate member to be formed by hardening and removing the resin material, hence improving the yield when ink jet heads are manufactured.

Also, in place of the peripheral member molding material, an isolated member is arranged in a location apart by a given distance from or in contact with the side portion where the nozzle member molding material on the circumference of the liquid chamber molding material is not connected with the molding member. After such arrangement is made, a resin material is coated, hence making it possible to obtain the same effect as described above.

What is claimed is:

1. A method for manufacturing an ink jet head, comprising:

a step of arranging on a substrate a passage molding material to form an ink passage, said ink passage including a plurality of nozzle portions communicating with plural discharge ports, respectively, and a common ink chamber commonly communicating with said plurality of nozzle portions, and an edge portion molding material in a vicinity of said passage molding material corresponding to said common ink chamber;

a step of arranging on said substrate a wall formation material having a height of 100 $\mu$m or less to cover said passage molding material and said edge portion molding material so as to form a difference in height of said wall formation material according to presence of said passage molding material and said edge portion molding material; and a step of removing at least said passage molding material from said substrate to form said ink passage with said wall formation material.

2. A method for manufacturing an ink jet head according to claim 1, wherein said edge portion molding material is arranged in the vicinity of the end portion of a part of said passage molding material for forming said common ink chamber.

3. A method for manufacturing an ink jet head according to claim 1, wherein said edge portion molding material is connected with said passage molding material on said substrate and arranged to extrude from said passage molding material.

4. A method for manufacturing an ink jet head according to claim 1, wherein said edge portion molding material is arranged on the substrate apart from said passage molding material.

5. A method for manufacturing an ink jet head according to claim 1, wherein said wall formation material is formed by a negative type photosensitive resin.

6. A method for manufacturing an ink jet head according to claim 1, wherein said discharge ports are formed between said wall formation material arranging step and said removing step.

7. An ink jet head comprising:

plural discharge ports for discharging ink, a substrate having energy generating elements arranged thereon to generate energy for discharging ink from the discharge ports; and a wall formation material having a height of 100 $\mu$m or less connected to said substrate having recesses arranged to form the walls of an ink passage, said ink passage including a plurality of nozzle portions communicating with said plural discharge ports, respectively, and a common ink chamber commonly communicating with said plurality of nozzle portions, wherein edge recesses different from said recesses are further arranged in s aid wall formation material, wherein said recesses in said wall formation material are formed by a passage molding material and said edge recesses are formed by an edge portion molding material in a vicinity of said passage molding material corresponding to said common ink chamber, and said wall formation material has a difference in height according to location of said ink passage and said edge recesses.

8. An ink jet head according to claim 7, wherein said edge recesses are conductively connected with said passage on said substrate, and provided to extrude from said passage.

9. An ink jet head according to claim 7, wherein said edge recesses are provided apart from said passage on said substrate.

10. An ink jet head according to claim 7, wherein said edge recesses form a space.

11. An ink jet head according to claim 7, wherein the edge portion molding material used for forming said edge recesses remains in said edge recesses.

12. An ink jet head according to claim 7, wherein ink supply inlets are provided on said substrate for supplying ink to said passage.

13. An ink jet head according to claim 7, wherein said energy generating elements are electrothermal transducing elements for generating thermal energy as said energy.

14. An ink jet head comprising:

plural discharge ports for discharging ink;

a substrate having energy-generating elements arranged thereon to generate energy for discharging ink from the discharge ports; and a wall formation material having a height of 100 $\mu$m of less connected to said substrate having recesses arranged to form the walls of an ink passage, said ink passage including a plurality of nozzle portions communicating with said plural discharge ports, respectively, and a common ink chamber commonly communicating with said plurality of nozzle portions, wherein edge recesses different from said recesses are further arranged in said wall formation material, wherein said edge recesses are in a vicinity of said common ink chamber, and said wall formation material has a difference in height according to location of said ink passage and said edge recesses.

* * * * *

UNITED STATES PATENT AND TRADEMARK OFFICE

CERTIFICATE OF CORRECTION

PATENT NO. : 6,145,965
DATED : November 14, 2000
INVENTOR(S) : Genji Inada, et al.

Figure 14:
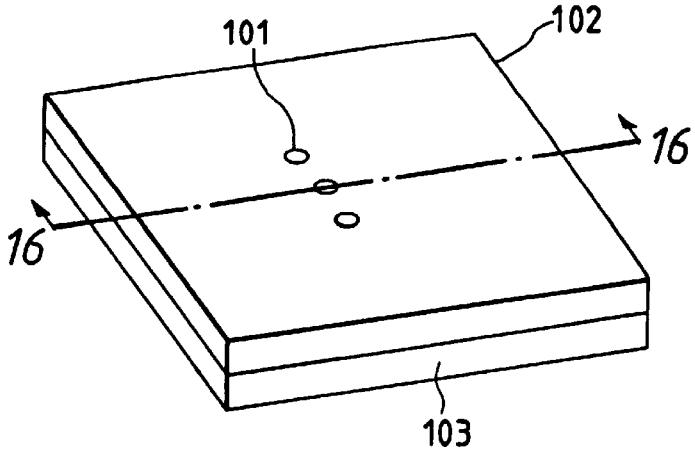
FIG. 14 PRIOR ART
FIG. 14 is a perspective view which shows a thermal ink jet head of the so-called side shooter type.
Figure 15:
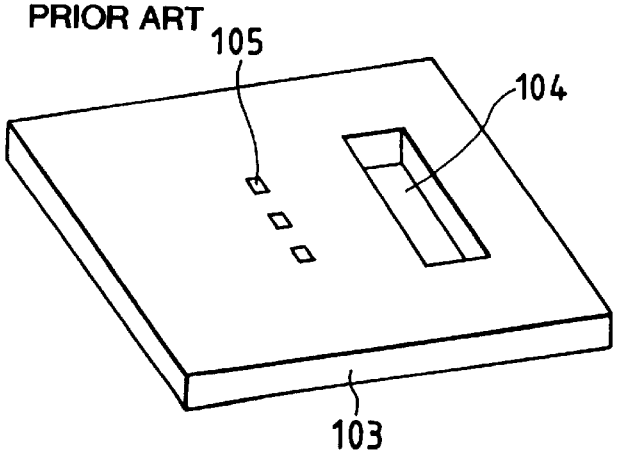
FIG. 15 PRIOR ART
FIG. 15 is a perspective view which shows the heater board constituting the head represented in FIG. 14.
Figure 16:
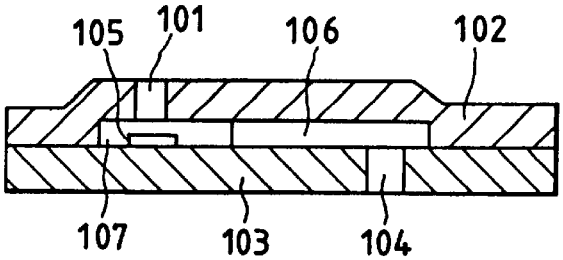
FIG. 16 PRIOR ART
FIG. 16 is a cross-sectional view of the ink jet head, taken along line 16—16 in FIG. 14.
Figure 17A:
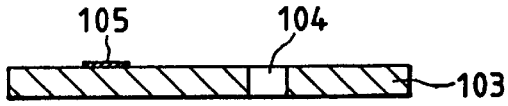
FIG. 17A PRIOR ART
FIGS. 17A to 17G are views illustrating the conventional method for manufacturing an ink jet head.
Figure 17B:
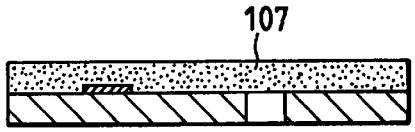
FIG. 17B PRIOR ART
Figure 17C:
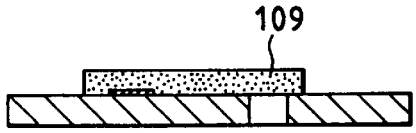
FIG. 17C PRIOR ART
Figure 17D:
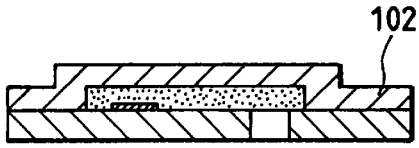
FIG. 17D PRIOR ART
Figure 17E:
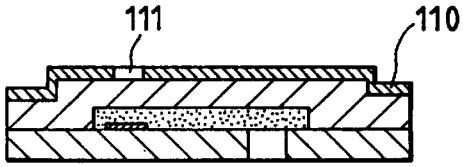
FIG. 17E PRIOR ART
Figure 17F:
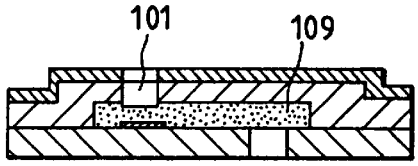
FIG. 17F PRIOR ART
Figure 17G:
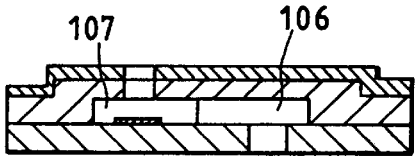
FIG. 17G PRIOR ART
Figure 18:
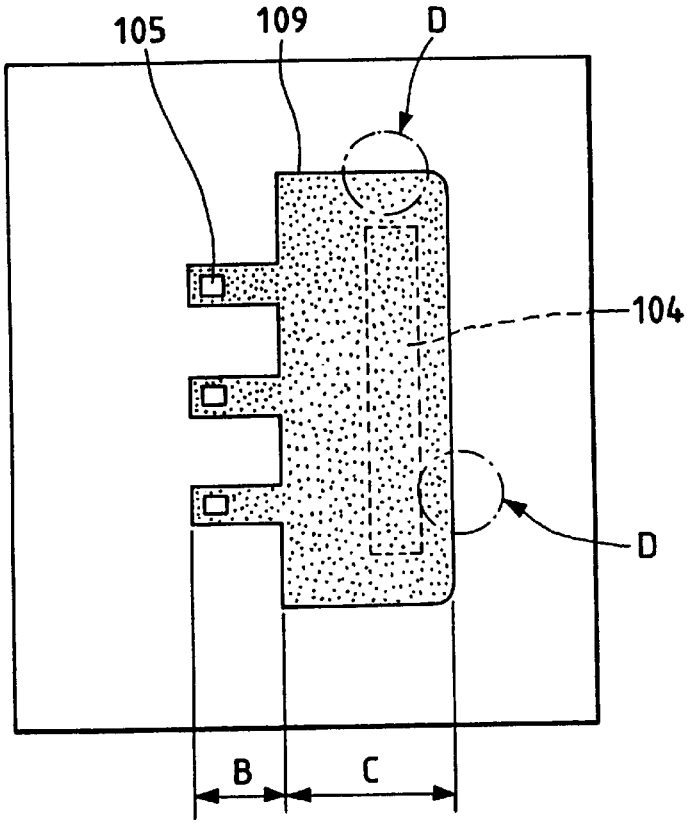
FIG. 18 PRIOR ART
FIG. 18 is a view showing the plane configuration of a molding member used for the conventional method for manufacturing an ink jet head.

It is certified that error appears in the above-identified patent and that said Letters Patent is hereby corrected as shown below:

Column 1:
Line 19, "4,723,129," should read -- 4,723,129), --.
Line 23, "advantages. FIG. 14" should read -- advantages. ¶FIG. 14 --.

Column 5:
Line 28, "protection" should read -- projection --.

Column 8:
Line 35, "therewith;" should read -- therewith; and --.

Column 10:
Line 9, "and" should read -- and the --.

Column 12:
Line 31, "The" should read -- In the --.

Column 13:
Line 5, "above, it" should read -- above --.

Column 14:
Line 6, "ink," should read -- ink; --.
Line 19, "s aid" should read -- said --.
Line 53, "μm of" should read -- μm or --.

Signed and Sealed this

Eleventh Day of September, 2001

*Attest:*

Nicholas P. Godici

*Attesting Officer*

NICHOLAS P. GODICI
*Acting Director of the United States Patent and Trademark Office*